US005782426A

United States Patent [19]

Kinnunen et al.

[11] Patent Number: 5,782,426

[45] Date of Patent: Jul. 21, 1998

[54] METHOD AND DEVICE FOR REELING A PAPER OR BOARD WEB

[75] Inventors: Jorma Kinnunen, Helsinki; Silvo Mikkonen, Jävenpää, both of Finland

[73] Assignee: Valmet Corp., Helsinki, Finland

[21] Appl. No.: 721,794

[22] Filed: Sep. 26, 1996

[30] Foreign Application Priority Data

Sep. 29, 1995 [FI] Finland ..... 954631

[51] Int. Cl.[6] ..... B65H 35/08

[52] U.S. Cl. ..... 242/526.3; 242/532.3; 242/541.5; 242/580

[58] Field of Search ..... 156/159, 509, 156/502; 242/541, 533, 533.1, 526.3, 541.4, 541.5, 580, 532.3

[56] References Cited

U.S. PATENT DOCUMENTS

| | | | |
|---|---|---|---|
| 4,695,004 | 9/1987 | Grossmann et al. | 242/526.3 |
| 5,014,924 | 5/1991 | Nowisch et al. | 242/526.3 |
| 5,251,835 | 10/1993 | Kyytsonen | 242/65 |
| 5,531,396 | 7/1996 | Kinnunen et al. | 242/526.3 |

FOREIGN PATENT DOCUMENTS

| | | | |
|---|---|---|---|
| 6-127764 | 5/1994 | Japan | 242/532.3 |
| 9206911 | 4/1992 | WIPO . | |

*Primary Examiner*—William Stryjewski
*Attorney, Agent, or Firm*—Steinberg, Raskin & Davidson, P.C.

[57] ABSTRACT

A method and device for reeling a paper or board web, wherein a first reel spool is in a reeling position in nip-defining relationship with a reeling cylinder and an empty second reel spool is placed in a stand-by position, the web is carried on a belt until it is reeled onto the first reel spool and the belt is guided in a run over the reeling cylinder and a guide roll, the first reel spool being transferred from the reeling position and pushed by the guide roll to a change position and the second reel spool is moved to the reeling position when the reel formed on the first reel spool is complete. The reeling of the web is transferred from the reel formed on the first reel spool to the second reel spool by cutting the entire width of the web by initially cutting a middle region of the web to form a tip and then extending the tip to side edges of the web, blowing the tip onto the second reel spool when the second reel spool is in the reeling position, and applying an adhesive proximate a rear edge of the web reeling onto the first reel spool in advance of a cut line separating the web reeling onto the first reel spool and the tip simultaneous with the cutting of the entire width of the web. The adhesive is applied at a uniform distance from the cut line so as to glue and fix the rear edge of the web to an underlying web portion of the web reeling onto the first reel spool.

20 Claims, 3 Drawing Sheets

METHOD AND DEVICE FOR REELING A PAPER OR BOARD WEB

FIELD OF THE INVENTION

The present invention relates to a method for reeling a paper or board web wherein the web is supported during the reeling by means of a belt which runs through a reeling nip formed between a reeling cylinder and a reel spool onto which the web is being wound and which runs in a guided path by means of a roll and the reel spool. When the paper or board reel that is formed on the reel spool becomes complete, the reel is pushed by means of the roll into a change or transfer position and a new, empty reel spool is lowered into a gap between the roll and the reeling cylinder and the change device is lowered onto the new, empty reel spool. In connection with the change device, a tip is cut out of the web from the middle of the web toward the edges of the web by means of water-cut nozzles, and the tip is blown around the new, empty reel spool by means of tip blowings and an adhesive is sprayed onto the web which is passing onto the paper or board reel just completed.

Further, the present invention also relates to a device for reeling a paper or board web which comprises a reeling cylinder and a reel spool, the web being arranged to run through a nip formed between the reeling cylinder and the reel spool onto the reel spool. In the device, the web is supported during the reeling by means of a belt which runs over the reeling cylinder and in a guided path by means of a guide roll, the reeling cylinder and the reel spool. The device also comprises members for guiding the web tip that is cut at the reel-change stage onto the new, empty reel spool and a change or transfer device which includes displaceable water-cut nozzles and displaceable adhesive nozzles.

BACKGROUND OF THE INVENTION

As is well known in the art of reeling a web, when the web is reeled by means of a drum reel-up or an equivalent reel-up, the web is passed on the face of the mantle of a carrier drum, reel drum, a reeling cylinder or equivalent before the reeling nip, while the web forms a belt angle over the reeling cylinder or equivalent.

A drum reel-up is used commonly to reel the paper web that comes, for example, from a paper machine, a coating machine, a supercalender or a printing machine. In a drum reel-up, the web is reeled onto a spool, and the reel that is being formed, i.e., the structure of the web being wound onto the reel spool in combination therewith, is pressed against a Pope cylinder, a reel drum or a reeling cylinder, over which the web runs on a certain sector and which is rotated at a circumferential speed that corresponds to the speed of the web. Before completion of the reel, a new, empty spool can be brought into nip-defining relationship with the reel drum or reeling cylinder so that it also obtains the corresponding circumferential speed. As soon as the reel of paper has obtained the desired diameter, it is transferred apart from the reel drum or reeling cylinder. Then its speed of rotation starts becoming lower, which has the consequence that, between the new reel spool and the full reel, a web loop is formed. This loop is guided, e.g., by means of a compressed-air jet, to be wound around the new, empty reel spool and is then torn apart from the full reel of paper so that the web starts to wind onto the new, empty reel spool.

It is conventional in drum reel-ups that at the reeling stage, normally the shaft or spool of the paper reel rests and revolves on two support rails. To permit this, there are particular bearing parts at ends of the reel shaft, which bearing parts also guide the transfer of the reel as it is transferred along the rails to further processing upon completion of the reel. In paper manufacture, this further processing is usually slitting which entails cutting the reel and unwinding it into smaller rolls of paper. The returning and changing of the empty reel spools can be carried out, for example, by means of a crane or other suitable machinery.

One of the most difficult parts of the control of the linear load is the stage in which the growing reel is transferred from the primary forks to the secondary forks. In practice, at this stage, there are noticeable variations in the linear load, which variations permit momentary sliding of the paper on the face of the reeling cylinder. This results in occasional wrinkling of the paper in the initial stage of the reeling. Moreover, at the reeling stage, for example drum reeling, the transfer from the primary forks to the secondary forks causes discontinuity in the reeling of the web and, as a result, broke in the center of the paper reel. The transfer of the reel from the primary forks to the secondary forks may also cause variations in the tightness in the paper, which variations may be a reason for sliding and for wrinkling of the paper.

One of the prior art means for avoiding the above-discussed problem and its consequences is to set the tension of the paper as low as possible by regulating the difference in speed between the reeling cylinder and the nearest drive mechanism preceding it. As stated above, in this connection, a limiting and restricting factor is the fluttering of the web and the resulting increased tendency of web breaks and deterioration of the quality properties of the paper, e.g., the formation of folds.

Another procedure used to avoid the above-discussed problem and its consequences is to increase the linear load between the growing reel of paper on the reel spool and the reeling cylinder to a level as high as possible by using an excessively high loading force on the support forks, especially on the secondary forks, with which loading force the reel is pressed against the reeling cylinder. A drawback of this procedure is a deterioration of the quality properties of the paper because, e.g., the tensile strength and the stretch of the paper are reduced.

With respect to the prior art most closely related to the method and device in accordance with the present invention, reference is made to Finnish Patent Application No. 905284 (corresponding to U.S. Pat. No. 5,251,835 assigned to the same assignee herein and the specification of which is hereby incorporated by reference herein) which describes a method for reeling a web wherein, when the machine reel becomes full, a new, empty reel spool is brought by means of transfer members into a stand-by position and accelerated to the web speed. At the same time as the machine reel connected to the center drive is shifted by means of the machine reel transfer device to an exchange position apart from the reeling cylinder, the new pre-accelerated reel spool is lowered onto the rails, and the exchange is carried out in a manner in itself known. Thereafter, the full machine reel is slowed down and the transfer device for the full machine reel is shifted to the new reel spool, and the center drive is connected to the new reel spool.

With the present paper machines and paper-surface treatment devices, attempts are made to achieve ever higher speeds, i.e., so-called high-speed reeling in which reeling the speed is higher than about 1600 meters per minute. High-speed reeling results in increased air resistance and friction, for example, an increase in speed makes the air resistance increases four-fold, which may lead to problems in the running of the web. While aiming at ever higher web reeling speeds, attempts are made to use a maximal proportion of recycled fibers. However, such recycled fibers are not as strong as virgin fibers. Further, at the same time, attempts are made to provide thinner paper grades, in which case the paper grade that is produced has a lower strength. In such cases, it is important to arrange the reel spool exchange in such a way that discontinuities in the reeling of the web do not arise, and at the same time, it is possible to more accurately control the reeling parameters.

With further respect to the prior art closely related to the present invention, reference is made to Finnish Patent Application No. 935669 (corresponding to U.S. Pat. No. 5,531,396 assigned to the same assignee herein and the specification of which is hereby incorporated by reference herein), in which a method and device are described for reeling a paper or board web in a drum reel-up or equivalent. In the method described in this application for reeling a paper or board web in a drum reel-up or equivalent, when a paper or board reel formed on a reel spool becomes complete, a new, empty reel spool is brought by means of transfer members into a stand-by position and accelerated up to the web speed. The reel spool with the reel is transferred by means of a transfer device into a change position apart from the reeling cylinder, and the new, initially accelerated reel spool is transferred into the reeling position. When the reel spool with the reel is transferred into the change position apart from the reeling cylinder, a belt guide roll is transferred into contact with the reel that is being formed onto the reel spool. The guide roll is transferred along with the reel spool into the change position so that the web runs during the entire change on support of the belt and through the nip between the guide roll and the reel spool.

OBJECTS AND SUMMARY OF THE INVENTION

Accordingly, it is an object of the present invention to provide a solution for the above problems in the exchange of reel spools during a reeling process to obtain a more efficient reeling method and device.

Another object of the invention is to improve the structure of the reel and to provide a stable running of the web during reeling, reel changes and threading.

Another particular object of the present invention is further development of the arrangement described in Finnish Patent Application No. 935669 for changing the reeling of a web and to provide an apparatus by whose means the reeling change can be carried out in a controlled manner so that the broke on the surface and in the center of the reel is eliminated and that formation of dust out of the web is reduced.

In view of achieving the objects stated above and others, in the method in accordance with the invention, the tip of the web is cut to be directed onto a new, empty reel spool at the same time with the gluing of the edges of the web passing onto the paper or board reel just completed so that the adhesive is spread at a uniform distance from the cut line so as to glue the final end of the web passing onto the full paper or board reel to fix the final end onto the face of the paper reel.

The device in accordance with the present invention includes a change device which comprises sledges or equivalent transfer devices to which a water cut nozzle and an adhesive nozzle are attached, and which sledges or equivalent are arranged to move along guides or equivalent guide means of the change device from the middle of the paper or board web (in a direction transverse to the running direction of the web) toward a respective one of the edges of the web by the intermediate of a respective actuator so that the water cut nozzles and the adhesive nozzles of the change device operate substantially at the same time end are placed in a relative position so that, parallel to each water cut, substantially at a uniform distance from the water cut line, an adhesive strip is formed at the side of the web portion that passes onto the complete reel.

In a reel-up in accordance with the present invention, the reel change can be accomplished in a controlled manner in a certain change arrangement by means of the change equipment. It is an essential feature of the invention that the application of the adhesive and the cutting of the web take place at the same time, substantially simultaneously, so that the adhesive is applied to a uniform width from the cut line so as to glue the tail passing onto the full reel to fix it to the reel face. In this manner, by means of the method and the device in accordance with the invention, at high speeds a controlled reel change and, thus, a reel of uniform quality are achieved, whereby the surface broke and center broke in the reel are substantially eliminated.

In one most basic embodiment of the method in accordance with the invention for reeling a paper or board web, a first reel spool is in a reeling position in nip-defining relationship with a reeling cylinder and an empty second reel spool is placed in a stand-by position, the web is carried on a belt until it is reeled onto the first reel spool, the belt is guided in a run over the reeling cylinder and a guide roll and the first reel spool is transferred from the reeling position and pushed by the guide roll to a change position and the second reel spool is lowered into the reeling position when the reel formed on the first reel spool is complete. The reeling of the web is transferred from the reel formed on the first reel spool to the second reel spool. To achieve the objects of the invention, the transfer of the reeling of the web comprises the steps of cutting the entire width of the web by initially cutting a middle region of the web to form a tip and then extending the tip to side edges of the web to thereby form a cut line separating the web reeling onto the first reel spool and the tip, directing the tip onto the second reel spool when the second reel spool is in the reeling position, and applying an adhesive proximate a rear edge of the web reeling onto the first reel spool in advance of the cut line in a running direction of the web and at a uniform distance from the cut line simultaneous with the cutting of the entire width of the web so as to glue and fix the rear edge of the web to an underlying web portion of the reel formed on the first reel spool. An extended nip may be produced between the belt and the reel formed on the first reel spool. Also, the guide roll may be pressed against the reel formed on the first reel spool to thereby press the web being reeled onto the first reel spool. The tip directing step comprises the steps of arranging a reel-change device vertically above the web and blowing air from a nozzle in the reel-change device in a direction downward toward the web or, in the alternative, arranging a reel-change device proximate the web and blowing air from the reel-change device at a location in alignment with a center of the guide roll.

One embodiment of the device in accordance with the invention for reeling a paper or board web is used in a drum reel-up which includes a reeling cylinder, a first reel spool situated in a reeling position in nip-defining relationship with the reeling cylinder whereby the web is guided through the nip onto the first reel spool, a guide roll and a belt passing over the reeling cylinder and the guide roll for supporting the web during reeling onto the first reel spool. The first reel spool is transferred from the reeling position and pushed by the guide roll to a change position and a second reel spool is transferred into the reeling position when the reel formed on the first reel spool is complete. To achieve the objects of the invention, the device includes cutting means for cutting the entire width of the web by initially cutting a middle region of the web to form a tip and then extending the tip to side edges of the web and guide means for guiding the tip onto the second reel spool when the second reel spool is in the reeling position. The cutting means comprise first and second water nozzles adapted to direct a penetrating water jet at the web. The device also includes adhesive means for applying an adhesive proximate a rear edge of the web reeling onto the first reel spool and which comprise first and second adhesive nozzles arranged to operate substantially simultaneously with the cutting means. The first water nozzle and first adhesive nozzle are mounted on a first sledge whereby the first adhesive nozzle is arranged relative to the first water nozzle such that a first strip of adhesive applied by the first adhesive nozzle to the rear edge of the web reeling onto the first reel spool is substantially parallel to and at a substantially uniform distance from a first cut line in the web resulting from the water jet from the first water nozzle. The second water nozzle and second adhesive nozzle are mounted on a second sledge whereby the second adhesive nozzle is arranged relative to the second water nozzle such that a second strip of adhesive applied by the second adhesive nozzle to the rear edge of the web formed on the first reel spool is substantially parallel to and at a substantially uniform distance from a second cut line in the web resulting from the water jet from the second water nozzle. The device also includes first displacement means for displacing the first sledge in a direction transverse to a running direction of the web, second displacement means for displacing the second sledge in the direction transverse to the running direction of the web, first guide means for guiding the displacement of the first sledge via the first displacement means from a middle region of the web to a first one of the side edges of the web, and second guide means for guiding the displacement of the second sledge via the second displacement means from the middle region of the web to a second one of the side edges of the web.

In other embodiments, the first and second water nozzles are arranged on the first and second sledges respectively such that an initial position of the first water nozzle is closer to the second side edge of the web than the second water nozzle and an initial position of the second water nozzle is closer to the first side edge of the web than the first water nozzle such that the first and second cut lines intersect each other during movement of the first and second sledges on which the first and second water nozzles are arranged, respectively. Similarly, the first and second adhesive nozzles are arranged on the first and second sledges respectively such that an initial position of the first adhesive nozzle is closer to the second side edge of the web than the second adhesive nozzle and an initial position of the second adhesive nozzle is closer to the first side edge of the web than the first adhesive nozzle such that the first and second adhesive strips intersect each other during movement of the first and second sledges on which the first and second adhesive nozzles are arranged, respectively. The first displacement means may comprise a first actuator coupled to the first sledge and the second displacement means may comprise a second actuator coupled to the second sledge, each of which comprise, e.g., a cylinder without a piston rod. The device can also include means for supplying water to the first and second water nozzles which are fluidly connected to the first and second water nozzles and means for supplying adhesive to the first and second adhesive nozzles which are fluidly connected to the first and second adhesive nozzles.

In the following, the invention will be described in more detail with reference to the figures in the accompanying drawings. However, the invention is not strictly confined to the details of the illustrations in these figures.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
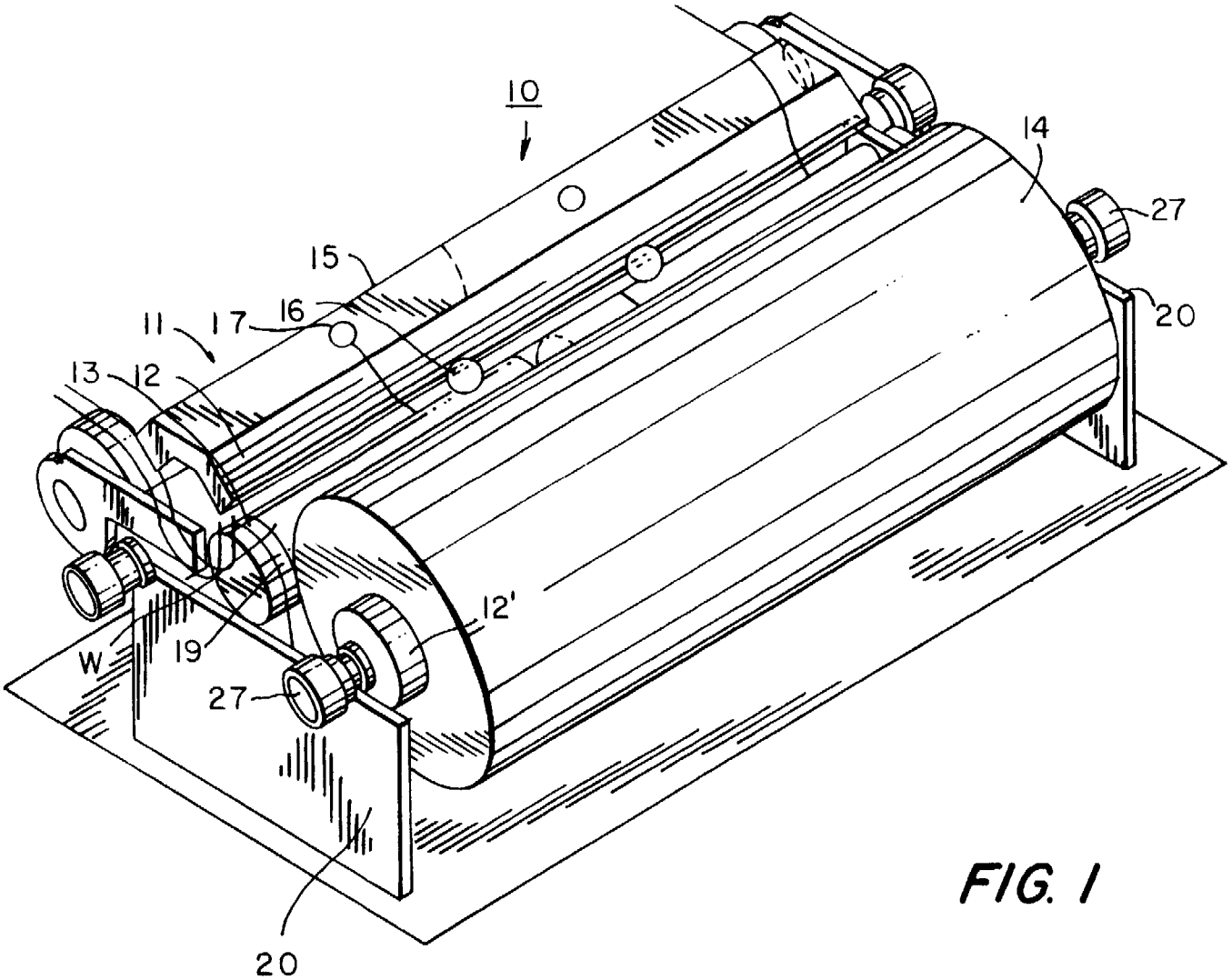
FIG. 1 is a schematic illustration of a reel-up in accordance with the invention.
Figure 2A:
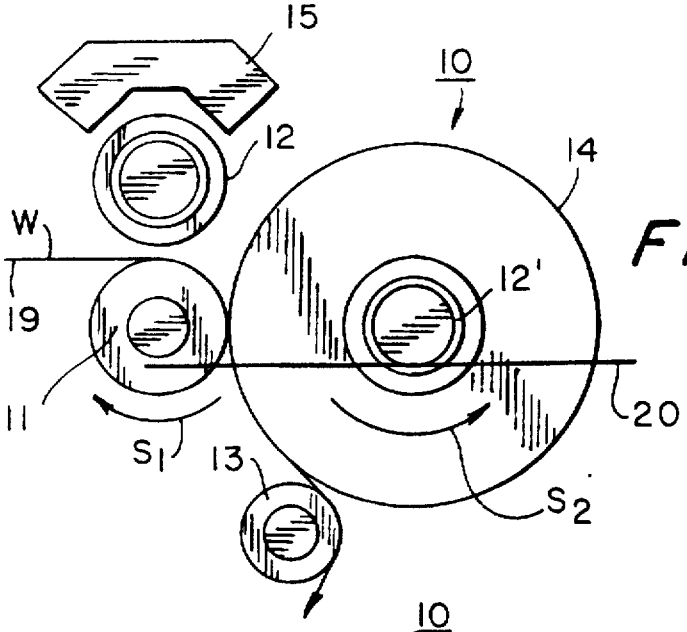
FIGS. 2A, 2B and 2C are schematic illustrations of the change sequence in reeling in a method and device in accordance with the invention.
Figure 2B:
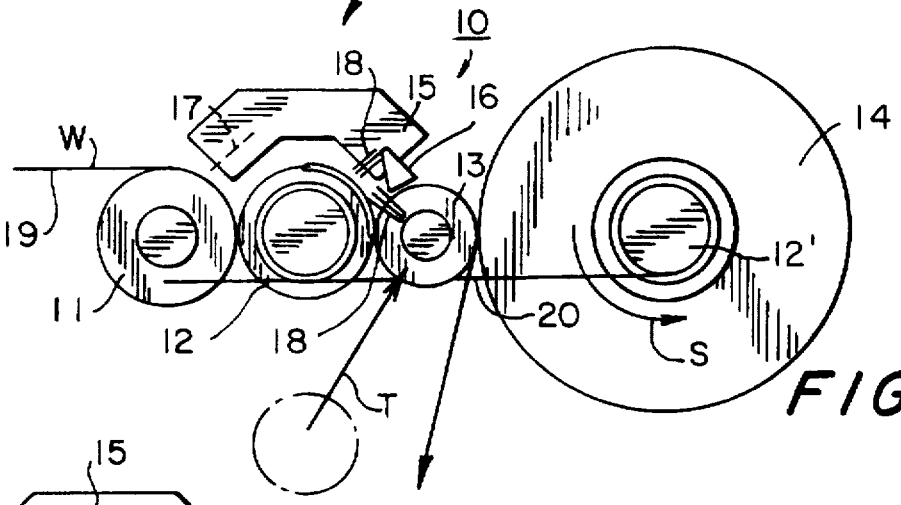
Figure 2C:
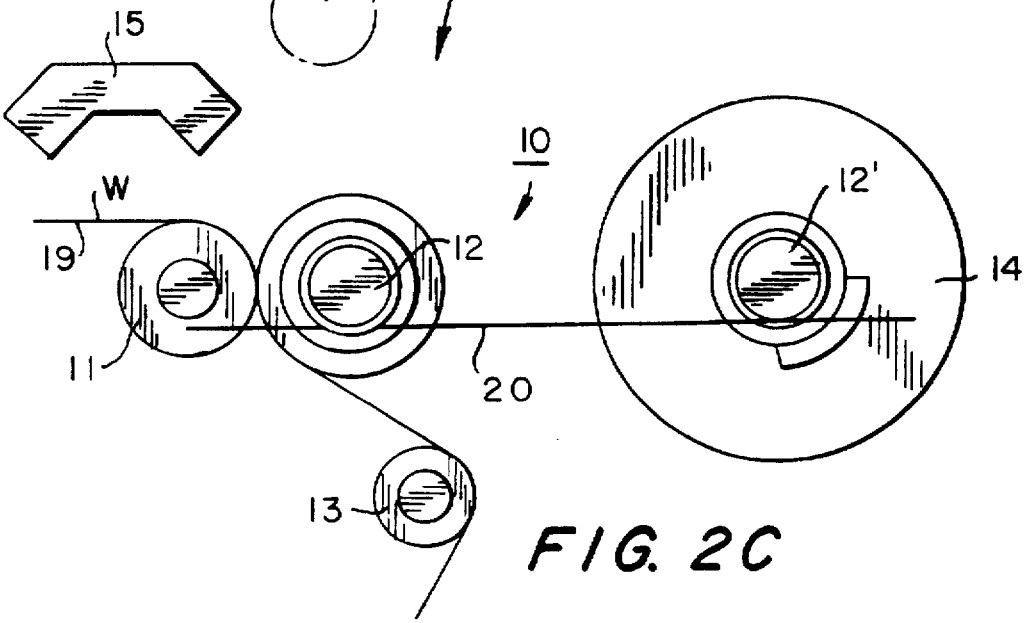

Referring to the accompanying drawings wherein the same reference numerals refer to the same elements, in FIG. 1 and in the sequential illustrations of a reel change shown in FIGS. 2A, 2B and 2C, the reel change operation is exemplified with reference to a drum reel-up or reeling device designated generally as 10 in which the main part of the drum reel-up 10 consists of a reeling cylinder 11. A paper web W runs on a belt over a circumferential portion of the reeling cylinder 11 before it is transferred onto the circumference of a paper reel 14 that is formed around a reel spool 12. The reel spool 12 rests on and revolves by means of bearing parts 27 in a reeling position on two support rails 20 or equivalent support constructions. A belt arrangement of the reel-up 10 comprises a belt 19, which can be a wire, felt, or any other fabric permeable to air. The belt 19 is guided in a run by guide rolls 13 (only one of which is shown and will hereinafter be referred to as "the guide roll 13") and through a reeling nip formed between the reeling cylinder 11 and the paper reel 14. The belt 19 supports the paper web W when the web W arrives at the reeling device 10 and until the paper web W is wound around the paper reel 14 that is formed around the reel spool 12. The belt 19 extends substantially across the entire width of the machine in the cross direction of the web W.

In the arrangement, it is possible to employ all types of reeling cylinder in themselves known such as grooved, perforated or smooth cylinders. It is also possible to use suction roll constructions. Preferably, a grooved reeling cylinder is utilized, in which case the control of air currents in the area of the reeling nip is easier. As used hereinafter, the term "nip" is defined as not only an ordinary nip shaped as a narrow line, but also as referring to any support zone.

In the reeling stage shown in FIG. 2A, the reeling cylinder 11 revolves in the direction indicated by arrow $S_1$, and the web W is reeled onto the reel drum, i.e., the reel spool 12'. The reel spool 12' revolves in the direction indicated by arrow $S_2$. The paper reel 14 formed around the reel spool 12' is almost complete, and a new reel spool 12 is in a stand-by position proximate the reeling cylinder 11. The guide roll 13, which operates as a rider roll at the same time, is also in a stand-by position near the reeling cylinder 11. The paper web W runs on support of the belt 19 from the reeling cylinder 11 onto the paper reel 14 that is being formed around the reel spool 12'. The belt 19 forms an extended nip between the reeling cylinder 11 and the paper reel 14, i.e., between the location of the reeling cylinder 11 and the paper reel 14 in opposed relationship thereto and the location of the guide roll 13 and the paper reel 14 proximate thereto. The length of this extended nip can be adjusted by means of the guide roll 13, e.g., by displacing the same, and the belt 19.

In the reeling stage shown in FIG. 2B, the reel spool 12' with the full paper reel 14 has been shifted in a manner in itself known to a reel change position, and the guide roll 13 has been shifted to a position in which it is against the paper reel 14 (the reeling cylinder 11 is no longer against the paper reel 14 as in the reeling stage shown in FIG. 1). The guide roll 13 is thus also shifted during the movement of the complete paper reel 14 to the change position. The new reel spool 12, which is pre-accelerated to a speed approximating the speed of the reeling cylinder 11, is lowered into the reeling position, for example onto the rails 20, and the reel change operation is carried out, which will be described in more detail below.

In the reeling stage shown in FIG. 2C, the reel change has taken place, and the paper web W has been cut off in the zone between the complete paper reel 14 and the reel spool 12, and the paper web W has been turned onto the new reel spool 12. As shown in FIG. 2C, the new reel spool 12 has been brought into contact with the reeling cylinder 11, and the new reel spool 12 revolves at the web speed. The full paper reel 14 on the reel spool 12 has been braked down (slowed from the reeling speed), and the rider roll 13 has been returned to its initial position.

The change device 15 for enabling the reel change is a beam construction having a width substantially equal to the width of the machine and includes water cutting nozzles and tail glue/adhesive nozzles which move from the middle area of the machine width to the sides of the machine (i.e., corresponding to movement in a direction from a middle area of the web to the side edges of the web). Other web cutting devices (which do not necessarily apply water to cut the web) and gluing/adhesive devices could also be used in conjunction with the change device 15. In FIG. 1, the water cut point of the web W is denoted by reference numeral 17, and the gluing point is denoted by reference numeral 16. As shown in the figures, the rider roll 13 is a movable roll by whose means the paper reel 14 can be pressed when it is separated from the reeling cylinder 11, thus almost always maintaining pressing engagement between a roll member and the paper reel 14. When the paper reel 14 reaches full size, it is pushed by means of the rider roll 13 into the position shown in FIG. 2B, and the new reel spool 12 is lowered between the rider roll 13 and the reeling cylinder 11. The change device 15 is lowered onto the new reel spool in the manner shown in FIG. 2B. The water cutting nozzles cut a wedge out of the web W from its middle area toward its side edges along the cutting points 17 in the manner shown in FIG. 1. The central region of the wedge is guided by means of tip blowings 18 to wrap around the new reel spool 12. The tip blowing 18 can be accomplished from above, and/or the tip blowing 18 can be obtained from holes provided on the center line of the rider roll 13.

The adhesive nozzles, which are synchronized in relation to the cutting nozzles, spray an adhesive agent onto the rear edges of the wedge at the side of the cut wedge of the web W that is destined to pass onto the paper reel 14 so that, upon adhesion of this adhesive agent to the underlying web portions, the paper reel 14 becomes a tight package without the possibility of loosening of the surface layers during braking down of the paper reel 14 (FIG. 2C). Upon a reel change, the rider roll 13 is lowered into the lower position and the reeling takes place in the manner shown in FIG. 2C.

Figure 3A:
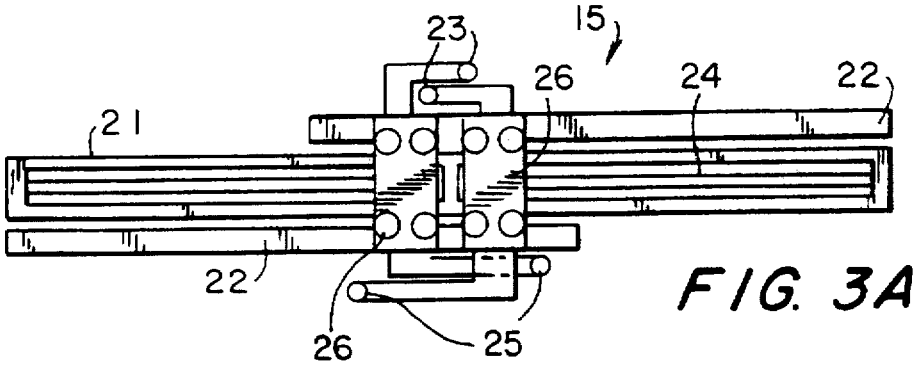
FIG. 3A is a top view of an embodiment of a change device in an initial position in accordance with the invention and used in a method in accordance with the invention.

As shown in FIG. 3A, the change device 15 comprises guides 21 oriented in a direction transverse to the running direction of the web, an energy transfer chain 22, water cutting nozzles 23, and adhesive nozzles 25 as well as cylinders 24. In the stage shown in FIG. 3A, the nozzles 23,25 are in their respective starting positions whereby the cutting nozzles 23 are at least at the same point, preferably placed crosswise in the manner shown in FIG. 3A, so that a sharp tip is obtained for the start of the web cutting operation (in view of the inherent crossing of the paths of the cutting nozzles 23). The adhesive nozzles 25 are placed somewhat behind in the running direction of the web and closer to the center of the web, because the wedge is narrower at this point after the cutting thereof.

Figure 3B:
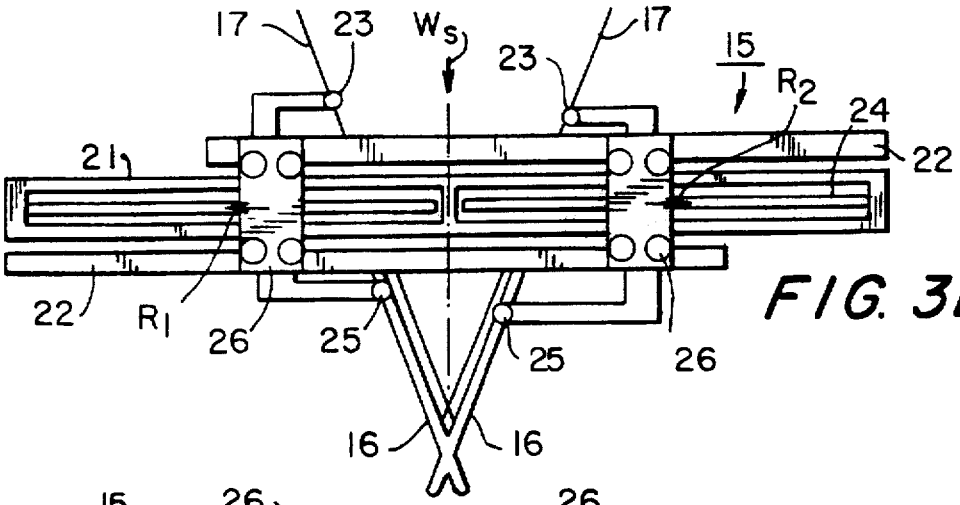
FIG. 3B is a top view of the change device in accordance with the invention and used in a method in accordance with the invention during an operational position.

FIG. 3B shows the nozzles 23,25 during movement, and the running direction of the web is denoted with the arrow $W_S$, the cut performed by the water jet nozzles is denoted by reference 17 and the adhesive joint is denoted by reference numeral 16. Note that the leftmost nozzles 23,25 in FIG. 3A are now the rightmost nozzles in FIG. 3B and are moving toward the right while the rightmost nozzles 23,25 in FIG. 3A are now the leftmost nozzles 23,25 in FIG. 3B so that at some point, the cuts provided by nozzles 23 intersect one another and the strips of adhesive agent provided by nozzles 25 intersect one another.

Figure 4:
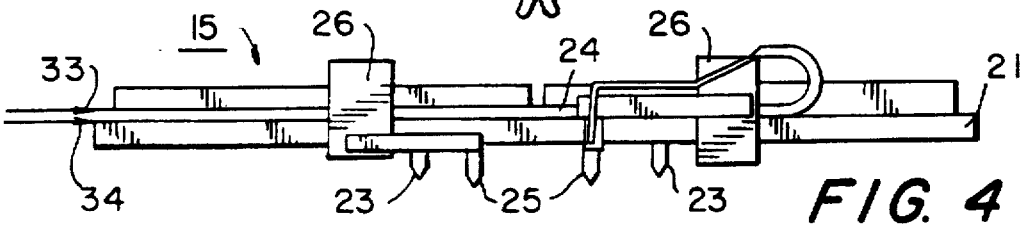
FIG. 4 is a front view of a first embodiment of a change device in accordance with the invention.

FIG. 4 shows the change device 15 viewed from the front, and the reference arrow 33 represents the supply of pressurized water to the cutting nozzles 23 and the reference arrow 34 represents the supply of adhesive to the adhesive nozzles 25. In this exemplifying Embodiment, the change device 15 includes sledges 26 which are displaceable by means of cylinders 24, which do not include piston rods, in conjunction with the guides 21. Other displacement means for displacing the sledges and guide means for guiding such displacement could also be used in accordance with the invention without deviating from the scope and spirit thereof.

Figure 5:
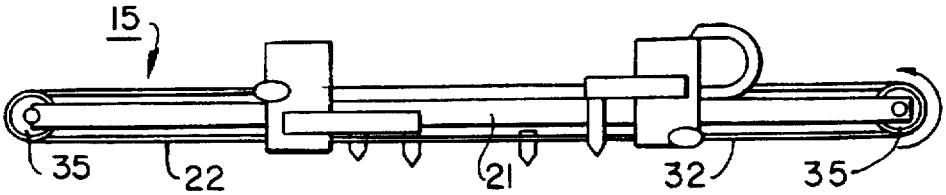
FIG. 5 is a front view of a second embodiment of a change device in accordance with the invention.

FIG. 5 shows a second exemplifying embodiment of the change device 15 in accordance with the invention, in which the displacement means comprise a chain 32 coupled to both the sledges and a motor 36 operatively coupled to the chain 32 for rotating the same so that the sledges are thus displaceable.

In the change device 15, the water cutting nozzles 23 and the adhesive nozzles 25 are attached to sledges or equivalent displaceable constructions 26 moving along guides 21. At the change stage, the sledges 26 start moving from the middle of the change device 15 (their initial position) in opposite directions, which is indicated by the arrows $R_1$,$R_2$ in FIG. 3B. Since the water cutting nozzles 23 are placed crosswise in the starting position in FIG. 3A, the water cuts 17 intersect each other at the starting stage of cutting shortly after cutting of the web begins. The adhesive nozzles 25 are also placed crosswise, and thus the adhesive strips 16 also intersect each other in the initial stage of gluing. The adhesive strips 16 accompany the cuts 17 at a distance, and are placed at a uniform distance on the web W portion that passes onto the paper reel 14, i.e., the rear edge of the web passing onto the completed reel. The movement of the sledges 26 or equivalent is produced, e.g., by means of an energy transfer chain 22 and cylinders 24, which do not necessarily include piston rods, or by means of a chain 32 and a motor 36 coupled to the chain 32 for rotating the same. The sledges 26 of the change device move up to the edges of the change device, which are substantially contiguous with and should even extend beyond the edges of the web, and thus cut off the web W completely, and at the same time, when the web W moves in its running direction $W_S$, the cutting nozzles 23 and the adhesive nozzles 25 make cuts 17 in the web and adhesive strips 16 on the web, respectively, substantially across the entire width of the web W.

The examples provided above are not meant to be exclusive. Many other variations of the present invention would be obvious to those skilled in the art, and are contemplated to be within the scope of the appended claims.

We claim:

1. In a method for reeling a paper or board web, wherein a first reel spool is in a reeling position in nip-defining relationship with a reeling cylinder and an empty second reel spool is placed in a stand-by position, the web being carried on a belt until it is reeled onto the first reel spool, the belt being guided in a run over the reeling cylinder and a guide roll, the first reel spool being transferred from the reeling position and pushed by the guide roll to a change position and the second reel spool being lowered into the reeling position when the reel forming on the first reel spool is complete, the reeling of the web being transferred from the reel formed on the first reel spool to the second reel spool while the first reel spool is in the change position and the second reel spool is in the reeling position, the improvement comprising:

the transfer of the reeling of the web while the first reel spool is in the change position and the second reel spool is in the reeling position comprising the steps of:

cutting the web across its entire width by initially cutting a middle region of the web to form a tip and then cutting the web between the middle region and side edges of the web by extending the tip to the side edges of the web to thereby form a cut line separating the web reeling onto the first reel spool and the tip, directing the tip onto the second reel spool after the tip has been formed by cutting the middle region of the web and before the tip is extended to the side edge of the web, and applying an adhesive onto the web reeling onto the first reel spool proximate a rear edge of the web in advance of the cut line in a running direction of the web and at a uniform distance from the cut line substantially simultaneously with the cutting of the web across its entire width so as to glue and thereby fix the rear edge of the web to an underlying web portion of the reel formed on the first reel spool.

2. The method of claim 1, further comprising the step of producing an extended nip between the belt and the reel forming on the first reel spool prior to the transfer of the reeling of the web from the first reel spool to the second reel spool while the first reel spool is in the reeling position and the reel forming on the first reel spool is not yet complete.

3. The method of claim 1, further comprising the step of pressing the guide roll against the reel forming on the first reel spool to thereby press the web being reeled onto the first reel spool prior to the transfer of the reeling of the web from the first reel spool to the second reel spool while the first reel spool is in the reeling position and the reel forming on the first reel spool is not yet complete.

4. The method of claim 1, wherein the tip directing step comprises the steps of arranging a reel-change device vertically above the web and blowing air from a nozzle in the reel-change device in a direction downward toward the web to cause the tip to contact the second reel spool.

5. The method of claim 1, wherein the web runs over the guide roll after the tip has been formed, the tip directing step comprising the step of blowing air from the guide roll along a center line of the guide roll over which the tip runs to cause the tip to separate from the guide roll and move toward the second reel spool.

6. The method of claim 1, wherein the step of cutting the web across its entire width comprises the step of directing pressurized water at the web.

7. The method of claim 1, wherein the web reeling transfer step further comprises the step of displacing a reel-change device into opposed relationship to the second reel spool after the second reel spool is lowered into the reeling position and before the cutting of the web, the step of cutting the web across its entire width comprising the steps of supplying pressurized water to the reel-change device and directing the pressurized water from the reel-change device at the web through nozzles arranged in the reel-change device.

8. The method of claim 1, wherein the web reeling transfer step further comprises the step of displacing a reel-change device into opposed relationship to the second reel spool after the second reel spool is lowered into the reeling position and before the cutting of the web, the step of applying an adhesive onto the web comprising the steps of supplying the reel-change device with the adhesive and directing the adhesive from the reel-change device at the web through nozzles arranged in the reel-change device.

9. The method of claim 1, further comprising the step of guiding the web over the reeling cylinder, then over the second reel spool, then over the guide roll and onto the first reel spool when the first reel spool is in the change position and the second reel spool is in the reeling position and before the cutting of the web, the step of cutting the web across its entire width comprising the step of directing pressurized water at the web as the web runs over the reeling cylinder and the step of applying an adhesive to the web comprising the step of directing the adhesive at the web as the web runs over the guide roll.

10. The method of claim 1, further comprising the steps of:

guiding the web over the reeling cylinder, then over the second reel spool, then over the guide roll and onto the first reel spool when the first reel spool is in the change position and the second reel spool is in the reeling position before the cutting of the web, and displacing a reel-change device into opposed relationship to the second reel spool while the second reel spool is in the reeling position and before the cutting of the web, the step of applying an adhesive onto the web comprising the steps of supplying the reel-change device with the adhesive and directing the adhesive from the reel-change device at the web as the web runs over the reeling cylinder through nozzles arranged in the reel-change device, and the step of cutting the web across its entire width comprising the steps of supplying pressurized water to the reel-change device and directing the pressurized water from the reel-change device at the web as the web runs over the guide roll through nozzles arranged in the reel-change device.

11. A device for transferring the reeling of a paper or board web in a drum reel-up, the drum reel-up including a reeling cylinder, a first reel spool situated in a reeling position in nip-defining relationship with said reeling cylinder whereby the web is guided through the nip onto said first reel spool, a guide roll and a belt passing over said reeling cylinder and said guide roll for supporting the web during reeling onto said first reel spool, said first reel spool being transferred from the reeling position and pushed by said guide roll to a change position and a second reel spool being transferred into the reeling position when the reel forming on said first reel spool is complete, the device comprising cutting means for cutting the web across its entire width by initially cutting a middle region of the web to form a tip and then cutting the web between the middle region and side edges of the web by extending the tip to the side edges of the web, said cutting means comprising first and second water nozzles adapted to direct a penetrating water jet at the web, guide means for guiding the tip onto the second reel spool when the second reel spool is in the reeling position, adhesive means for applying an adhesive proximate a rear edge of the web reeling onto the first reel spool, said adhesive means comprising first and second adhesive nozzles and being arranged to operate simultaneous with said cutting means, a first displaceable sledge, said first water nozzle and said first adhesive nozzle being mounted on said first sledge, said first adhesive nozzle being arranged relative to said first water nozzle such that a first strip of adhesive applied by said first adhesive nozzle to the rear edge of the web reeling onto the first reel spool is substantially parallel to and at a substantially uniform distance from a first cut line in the web resulting from said water jet from said first water nozzle, a second displaceable sledge, said second water nozzle and said second adhesive nozzle being mounted on said second sledge, said second adhesive nozzle being arranged relative to said second water nozzle such that a second strip of adhesive applied by said second adhesive nozzle to the rear edge of the web formed on the first reel spool is substantially parallel to and at a substantially uniform distance from a second cut line in the web resulting from said water jet from said second water nozzle, first displacement means for displacing said first sledge in a direction transverse to a running direction of the web, second displacement means for displacing said second sledge in the direction transverse to the running direction of the web, first guide means for guiding the displacement of said first sledge via said first displacement means from a middle region of the web to a first one of said side edges of the web, and second guide means for guiding the displacement of said second sledge via said second displacement means from the middle region of the web to a second one of said side edges of the web.

12. The device of claim 11, wherein said first and second water nozzles are arranged on said first and second sledges respectively such that an initial position of said first water nozzle is closer to said second side edge of the web than said second water nozzle and an initial position of said second water nozzle is closer to said first side edge of the web than said first water nozzle such that the first and second cut lines intersect each other during movement of said first and second sledges on which said first and second water nozzles are arranged, respectively.

13. The device of claim 12, wherein said first and second adhesive nozzles are arranged on said first and second sledges respectively such that an initial position of said first adhesive nozzle is closer to said second side edge of the web than said second adhesive nozzle and an initial position of said second adhesive nozzle is closer to said first side edge of the web than said first adhesive nozzle such that the first and second adhesive strips intersect each other during movement of said first and second sledges on which said first and second adhesive nozzles are arranged, respectively.

14. The device of claim 11, wherein said first and second adhesive nozzles are arranged on said first and second sledges respectively such that an initial position of said first adhesive nozzle is closer to said second side edge of the web than said second adhesive nozzle and an initial position of said second adhesive nozzle is closer to said first side edge of the web than said first adhesive nozzle such that the first and second adhesive strips intersect each other during movement of said first and second sledges on which said first and second adhesive nozzles are arranged, respectively.

15. The device of claim 11, wherein said first displacement means comprise a first actuator coupled to said first sledge and arranged to displace said first sledge in the direction transverse to the running direction of the web and said second displacement means comprise a second actuator coupled to said second sledge and arranged to displace said second sledge in the direction transverse to the running direction of the web.

16. The device of claim 15, wherein said first and second actuators each comprising a cylinder without a piston rod.

17. The device of claim 11, wherein said first and second displacement means comprise a joint chain coupled to both said first and second sledges, and a motor motively coupled to said chain for causing rotation of said chain and thus movement of said first and second sledges.

18. The device of claim 11, wherein said first and second guide means are structured and arranged to extend in a direction transverse to the running direction of the web.

19. The device of claim 11, further comprising means for supplying water to said first and second water nozzles, said water supply means being fluidly connected to said first and second water nozzles.

20. The device of claim 11, further comprising means for supplying adhesive to said first and second adhesive nozzles, said adhesive supply means being fluidly connected to said first and second adhesive nozzles.

* * * * *